United States Patent [19]

Stauff

[11] 4,073,213

[45] Feb. 14, 1978

[54] ASSEMBLY FOR LAUNCHING A PROJECTILE

[75] Inventor: Emile J. Stauff, Versailles, France

[73] Assignee: Societe Anonyme dite : Societe Europeenne de Propulsion, Puteau, France

[21] Appl. No.: 700,743

[22] Filed: June 29, 1976

[30] Foreign Application Priority Data

July 2, 1975 France ..... 75 20741

[51] Int. Cl.[2] ..... F41F 3/02; F41F 15/00

[52] U.S. Cl. ..... 89/1.701; 89/1.704

[58] Field of Search ..... 89/1.7, 1.701, 1.704, 89/1.814, 1.818; 60/35.6

[56] References Cited

U.S. PATENT DOCUMENTS

| | | | |
|---|---|---|---|
| 1,280,579 | 10/1918 | Stone et al. | 89/1.7 |
| 2,156,605 | 5/1939 | Prettyman | 89/1.701 |
| 2,956,479 | 10/1960 | Musser | 89/1.7 |
| 3,017,746 | 1/1962 | Kiphart | 60/35.6 UX |
| 3,446,111 | 5/1969 | Dardick | 89/1.7 |

FOREIGN PATENT DOCUMENTS

| | | | |
|---|---|---|---|
| 2,260,078 | 5/1973 | France | 89/1.818 |
| 2,352,483 | 4/1975 | Germany | 89/1.704 |
| 624,582 | 6/1949 | United Kingdom | 89/1.814 |
| 631,261 | 10/1949 | United Kingdom | 89/1.701 |

*Primary Examiner*—David H. Brown

*Attorney, Agent, or Firm*—Fulwider, Patton, Riber, Lee & Utecht

[57] ABSTRACT

An assembly for launching a projectile comprises a launching tube having a smooth or rifled bore, a charge of gunpowder located in the tube for firing a projectile which is loaded in the tube in front of the charge, and a body of braking propellent which is located in the tube behind the gunpowder charge and which consists almost entirely of combustible substances. The body of braking propellent may be connected to the projectile by means of a cylindrical sleeve to form a rigid unit which is loadable as a round in the launching tube, the sleeve containing the gunpowder charge.

5 Claims, 2 Drawing Figures

ASSEMBLY FOR LAUNCHING A PROJECTILE

Figure 1:
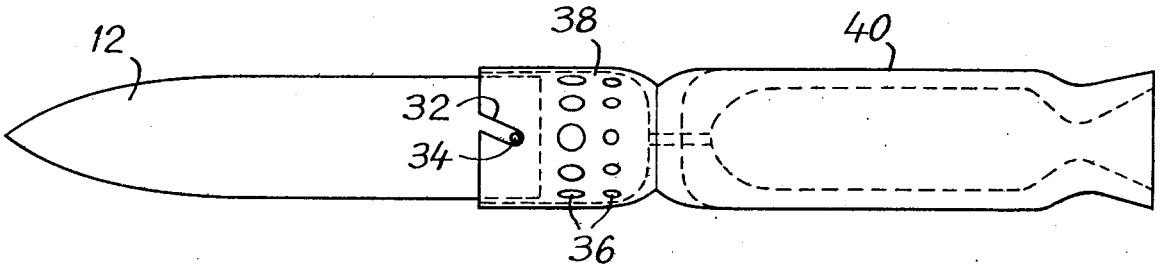

This invention relates to the launching of a projectile from a smooth-bore or rifled launching tube into which the projectile is loaded.

It is known, for example, from French Patent Specification No. 943 319 to make a projectile launcher comprising a combustion chamber which is freely mobile in a launching tube which is open at both ends, the combustion chamber having two entirely separate compartments containing propulsive charges. One of the charges, which is the first to be ignited and is in the compartment open towards the rear end of the tube, is arranged to absorb the recoil when the projectile is fired. The other propulsive charge, which is in the compartment opening towards the front of the tube and is ignited second, is arranged to propel the projectile from the tube. A disadvantage of this arrangement is that the compartment which opens towards the rear of the tube, and which includes a tubular nozzle, is made of a non-combustible material and consequently forms a rigid body of considerable mass, which is difficult to decelerate.

The present invention is intended to avoid this disadvantage, while at the same time providing a projectile launcher with which three important criteria can be met. Firstly, it is desirable to minimize reactive forces applied to the launching tube, so that the launching tube can be light in weight and so that the projectile can be launched accurately with minimal deflection of aim. Secondly, it is desirable to give the projectile a high acceleration. Thirdly, it is desirable that as little gas as possible should be projected forwards and backwards from the launching tube, so as to interfere as little as possible with the field of view of an operator who needs to continue aiming after the projectile has left the tube, and also so as to minimize the firing signature of the weapon, that is to say the ease with which the launch location may be spotted due to the emission of smoke and gas. Also, the flight of the projectile, and the operation of its guiding system, if any, should be disturbed as little as possible.

According to the invention, an assembly for launching a projectile comprises a launching tube having a smooth or rifled bore, a charge of gunpowder located in the tube for firing from the tube a projectile which is loaded in the tube in front of the charge, and a body of braking propellent consisting almost entirely of combustible substances positioned in the tube behind the gunpowder charge.

In this case, the mass at the rear of the assembly consists of a combustible mass which burns very rapidly. The molecules of the ejected hot gases are decelerated by the ambient air. Preferably, the body of braking propellent comprises a block of propellent powder having a hollow interior which forms a tubular nozzle.

The body of braking propellent may be connected to the projectile by means of a cylindrical sleeve which contains the gunpowder and which forms the entire round, that is to say the projectile, the gunpowder charge and the body of braking propellent, into a rigid unit for loading as a unit into the launching tube. Such a unit is itself novel and forms an important aspect of the present invention.

The connecting sleeve may be attached to the body of braking propellent by means of a base at the rear end of the sleeve, the base preferably being bonded to the body of braking propellent by an inhibitor. Furthermore, at least part of the connecting sleeve and the body of braking propellent may be surrounded by a jacket of resin bonded wound filaments, both the filaments and their resin binder being combustible.

The launching assembly is preferably equipped with an automatic loading device, for example of the revolver cylinder type. Alternatively, the automatic loading device may comprise a number of arms for supporting the rounds to be loaded, the arms being equipped with means for opening them when a round is fired, to prevent damage to the arms from the jet of combustion gases.

Preferably, the body of braking propellent is arranged to be ignited first, to give the round as a whole an initial forward movement and the gunpowder charge is separated from the body of braking propellent by means containing at least one calibrated orifice through which the gunpowder is ignited by the braking propellent a predetermined interval after ignition of the braking propellent.

Figure 2:
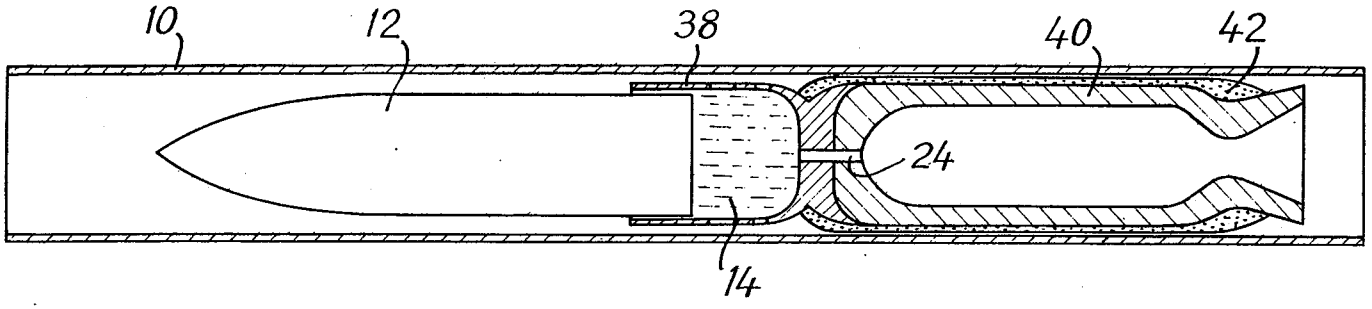

An example of a launching assembly in accordance with the invention will now be described with reference to the accompanying drawings, in which:

FIG. 1 is a side elevation of a part of the launching assembly, i.e. a part which is loaded as a unit into the launching tube and which consists of a projectile connected to a body of braking propellent; and, FIG. 2 is a longitudinal section through the launching assembly, showing the unit or round of FIG. 1 loaded in a launching tube.

FIG. 2 shows a conventional launching tube 10, which may have a smooth or rifled bore, and in which is loaded a projectile 12 to be launched. A charge of gunpowder 14 is situated behind the projectile 12, and behind the gunpowder there is a body of braking propellent 40. This body consists of an elongated block of propellent powder with a hollow interior which, as represented in the drawings, forms an essentially tubular combustion nozzle. This nozzle may be produced by a machining operation or may be moulded directly in the block. The entire body of braking propellent is of highly combustible material which can burn away in the course of a few hundredths of a second, and it will be appreciated that the braking effect is due partly to reaction from the accelerated mass of propellent and partly to an aerodynamic effect acting on the combustion gases.

The body of braking propellent 40 is connected to the projectile 12 by a cylindrical sleeve or crown 38 which contains the gunpowder 14 for propelling the projectile. This crown 38 holds the entire round, consisting of the projectile 12 + gunpowder 14 + the body of braking propellent 40, together to form a rigid unit as shown in FIG. 1. This unit is loaded as a whole into the launching tube 10. The connecting sleeve or crown 38, which may be of mixed construction, is preferably bonded to the body 40 by an inhibitor. As shown in FIG. 2, the crown 38 and the braking body 40 may be enclosed in a jacket 42 of resin bonded wound filaments, both the filaments themselves and the binding resins being combustible.

The connecting sleeve or crown 38 is provided with a number of apertures 36 arranged so that, when the braking body 40 and the crown 38 leave the rear end of the launching tube after the projectile has been fired, the apertures clear the back end of the launching tube one after another and thereby allow the combustion gases from the gunpowder to escape comparatively gradually.

Operation of the launching assembly in accordance with the invention is as follows:

On firing, it is preferably the body of braking propellent 40 which is ignited first. This imparts a certain amount of forward movement to the round as a whole. After a precisely determined interval of time the gunpowder 14 is ignited by gases from the burning braking propellent 40 through at least one calibrated orifice or passage 24 in the base of the crown 38 between the braking body 40 and the gunpowder 14.

This programme of actions allows the gun effect to be reduced to a certain extent, the final velocity of the projectile being constant. A further advantage is that at the firing instant the round can be situated comparatively far back in the launching tube. Finally, the backward velocity of the braking body 40 is reduced.

If the projectile 12 is itself equipped with a charge of cruising propellent, this can be ignited by allowing burning gases to reach the cruise propellent through the jet orifice of the cruise combustion chamber, or through a calibrated orifice for limiting the gas pressure, the dimensions of the calibrated orifice being calculated on the basis of the volume to be filled and the time delay desired before ignition.

It is a preferred feature of the assembly in accordance with the present invention that the connection between the projectile 12 and the connecting crown 38 has means for imparting to the projectile an angular acceleration dw/dt when the projectile is fired. After the projectile has separated from the connecting crown, that is to say from the launching system shown in FIG. 2:

$$I_1w_1 + I_2w_2 = 0$$

where $I_1$, $I_2$ are the moments of inertia of the projectile and the launching system respectively, and $w_1$, $w_2$ are the rotational speeds of these components.

In the example shown, the cylindrical connecting sleeve or crown 38 has one or more grooves or slots 32 which extend obliquely to the axis of the launching tube 10. Pins 34 fixed to the projectile 12 near its back and engage in the slots 32, and when the projectile is fired, the displacement of the pins in the slots as the projectile separates from the crown imparts rotation to the projectile.

The method of operation of the projectile launching assembly in accordance with the invention fits particularly well with automatic loading mechanisms, for example of the revolver cylinder type or of the kind having arms which support the rounds and which are controlled so that they are open when the round is fired, to prevent damage from the jet of combustion gases.

It will be understood, of course, that the present invention is not limited to the particular example described and illustrated, but also covers various alternative arrangements within the scope of the claims. For example, as described in French Patent Specification No. 74 36676, the projectile launching assembly may, if desired, be arranged so that the gunpowder which propels the projectile is ignited before the body of braking propellent. In this case, the pins for imparting rotation to the projectile may be fixed to the inside of the launching tube, the grooves into which the pins engage being formed in the projectile.

I claim:

1. A projectile launching assembly including a launching tube, a charge of gunpowder located in said launching tube for firing from said tube a projectile which is loaded in said tube in front of said gunpowder charge, a body of braking propellent powder consisting almost entirely of highly combustible substances positioned in said launching tube behind said gunpowder charge, and comprising a block having, at least, a partially hollow interior forming a tubular nozzle and a cylindrical sleeve connecting said projectile to said body of braking propellent to form a rigid unit which is loadable as a unit into said launching tube, said gunpowder charge being contained within said cylindrical sleeve, and a jacket of resin bonded wound filaments surrounding said body of braking propellent and at least part of said connecting sleeve, said wound filaments and their resin binder both being combustible.

2. A projectile launching assembly including a launching tube, a charge of gunpowder located in said launching tube for firing from said tube a projectile which is loaded in said tube in front of said gunpowder charge, a body of braking propellent powder consisting almost entirely of highly combustible substances positioned in said launching tube behind said gunpowder charge, and comprising a block having, at least, a partially hollow interior forming a tubular nozzle and a cylindrical sleeve connecting said projectile to said body of braking propellent to form a rigid unit which is loadable as a unit into said launching tube, said gunpowder charge being contained within said cylindrical sleeve, said cylindrical sleeve being provided with a series of apertures whereby, after firing of said projectile, said apertures clear the back end of said launching tube one after another, following said body of braking propellent, thereby enabling combustion gases from said gunpowder charge to escape from said launching tube comparatively gradually.

3. A projectile launching assembly including a launching tube, a charge of gunpowder located in said launching tube for firing from said tube a projectile which is loaded in said tube in front of said gunpowder charge, a body of braking propellent powder consisting almost entirely of highly combustible substances positioned in said launching tube behind said gunpowder charge, and comprising a block having, at least, a partially hollow interior forming a tubular nozzle and separation means between said body of braking propellant and said gunpowder charge with interconnecting orifice means of calibrated dimension to permit said braking propellant to ignite said gunpowder charge a predetermined interval after ignition of said braking propellant.

4. A projectile launching assembly including a launching tube, a charge of gunpowder located in said launching tube for firing from said tube a projectile which is loaded in said tube in front of said gunpowder charge, a body of braking propellent powder consisting almost entirely of highly combustible substances positioned in said launching tube behind said gunpowder charge, and comprising a block having, at least, a partially hollow interior forming a tubular nozzle and a cylindrical sleeve connecting said projectile to said body of braking propellent to form a rigid unit which is loadable as a unit into said launching tube, said gunpowder charge being contained within said cylindrical sleeve, and cooperating means on said projectile and said cylindrical connecting sleeve for imparting an angular acceleration to said projectile when said projectile is fired.

5. An assembly as claimed in claim 4, wherein said co-operating means comprises at least one groove or slot in said sleeve extending obliquely with respect to the axis of said launching tube, and a pin fixed to said projectile near its back end and engaging in said groove or slot.

* * * * *